US008897469B2

(12) United States Patent
Yu

(10) Patent No.: US 8,897,469 B2
(45) Date of Patent: Nov. 25, 2014

(54) SLIM SPEAKER STRUCTURE HAVING VIBRATION EFFECT

(71) Applicants: Abatech Electronics Co., Ltd., New Taipei (TW); Hsiang-Chih Yu, New Taipei (TW)

(72) Inventor: Hsiang-Chih Yu, New Taipei (TW)

(73) Assignee: Abatech Electronics Co., Ltd., New Taipei (TW)

( * ) Notice: Subject to any disclaimer, the term of this patent is extended or adjusted under 35 U.S.C. 154(b) by 16 days.

(21) Appl. No.: 13/798,029

(22) Filed: Mar. 12, 2013

(65) Prior Publication Data

US 2014/0270319 A1 Sep. 18, 2014

(51) Int. Cl.
*H04R 7/04* (2006.01)
*H04R 1/00* (2006.01)

(52) U.S. Cl.
CPC ..... *H04R 1/00* (2013.01)
USPC ..... 381/152; 381/190; 381/191; 381/162; 381/431

(58) Field of Classification Search
USPC ..... 381/152, 162, 388, 190, 191, 431, 386; 310/324, 348
See application file for complete search history.

(56) References Cited

U.S. PATENT DOCUMENTS 4,471,258 A * 9/1984 Kumada ..... 310/345
4,751,419 A * 6/1988 Takahata ..... 310/324
5,965,970 A * 10/1999 Takeuchi et al. ..... 310/324
6,188,775 B1 * 2/2001 Azima et al. ..... 381/431
6,377,695 B1 * 4/2002 Azima et al. ..... 381/152
6,478,109 B1 * 11/2002 Kam ..... 181/177
6,519,347 B1 * 2/2003 Morecroft et al. ..... 381/152
6,522,760 B2 * 2/2003 Azima et al. ..... 381/152
6,914,993 B2 * 7/2005 Watanabe ..... 381/190
7,586,241 B2 * 9/2009 Kuroda et al. ..... 310/348
7,817,810 B2 * 10/2010 Cheung ..... 381/152
8,089,198 B2 * 1/2012 Bianchini ..... 310/324
2006/0214540 A1 * 9/2006 Yuu ..... 310/324
2012/0082326 A1 * 4/2012 Kano ..... 381/190
2012/0230524 A1 * 9/2012 Chang et al. ..... 381/190
2014/0050339 A1 * 2/2014 Yu ..... 381/190

* cited by examiner

*Primary Examiner* — Curtis Kuntz
*Assistant Examiner* — Joshua A Kaufman
(74) *Attorney, Agent, or Firm* — Leong C. Lei

(57) ABSTRACT

A slim speaker structure having a vibration effect includes a frame, ceramic elements configured on a surface of the frame, and a sound membrane disposed on the bottom of frame, where at least two first accepting portions are respectively configured on the frame adjacent to the sides thereof, allowing the corners of the first accepting portions to be respectively coupled to the main body of the frame with an overhanging section, and a second accepting portion is configured on the center of the frame, thereby allowing different response frequencies of vibration and sound ceramic elements to be mounted on the respective first and second accepting portions so as to constitute a slim speaker structure having a vibration effect, capable of being applied on cellular phones or tablets with a touch screen. Therefore, the vibration prompt and sound broadcasting can be constituted at the same plane through the different ceramic elements.

2 Claims, 4 Drawing Sheets

SLIM SPEAKER STRUCTURE HAVING VIBRATION EFFECT

(a) TECHNICAL FIELD OF THE INVENTION

The present invention relates to a slim speaker structure having a vibration effect, and more particularly to a slim speaker structure having a vibration effect, in which sound broadcasting and vibration prompt can be constituted at the same plane through different response frequencies of ceramic elements, thereby to apply on products such as cellular phones or tablets with a touch screen, allowing the products to be more thinned.

(b) DESCRIPTION OF THE PRIOR ART

General 3C products such as Ipad, Iphone, cellular phones and tablets are developed gradually toward the ones of lightness, thinness, shortness and smallness due to the fast progress of the modern technologies such that parts used in the products must also be thinned. But, with respect to sound emitting speakers and called number identification (CNI) vibration elements among them, the current speaker might achieve miniaturization, but cannot be lighter and thinner, and a micromotor with an eccentric wheel is mostly used in the vibration elements, causing volume thereof to be difficult to conform with product requirements. Furthermore, because a miniaturized speaker and vibration elements cannot be configured on the same plane, the thickness of a product including them is difficult to be reduced.

SUMMARY OF THE INVENTION

The main object of the present invention is to provide a slim speaker structure having a vibration effect, constituting sound broadcasting and vibration prompt on the same plane through different ceramic elements, thereby to apply on products such as cellular phones or tablets with a touch screen, allowing the products to be more thinned.

The slim speaker structure having a vibration effect includes a frame, ceramic elements configured on a surface of the frame, and a sound membrane disposed on the bottom of frame, where two or more than two first accepting portion respectively configured on the frame adjacent to the sides thereof, allowing the corners of the first accepting portions are respectively coupled to the main body of the frame with an overhanging section, and a second accepting portion is configured on the center of the frame, thereby mounting different response frequencies of vibration and sound ceramic elements on the respective first and second accepting portions so as to constitute a slim speaker structure having a vibration effect, capable of being applied on cellular phones or tablets with a touch screen. Therefore, the vibration prompt and sound broadcasting can be constituted at the same plane through the different ceramic elements.

The slim speaker structure having a vibration effect mentioned above, in which the overhanging section between the first accepting portion and frame is a strip-typed and approximately continuously bended body, can eliminate oscillatory wave interference to the sound ceramic element of the second accepting portion.

The slim speaker structure having a vibration effect mentioned above allows the second accepting portion to be coupled to the main body of the frame with corrugated arch section, thereby to constitute an elastic wave action of a general speaker, and further increase the sound quality of the sound ceramic element.

DETAILED DESCRIPTION OF THE PREFERRED EMBODIMENTS

Figure 1:
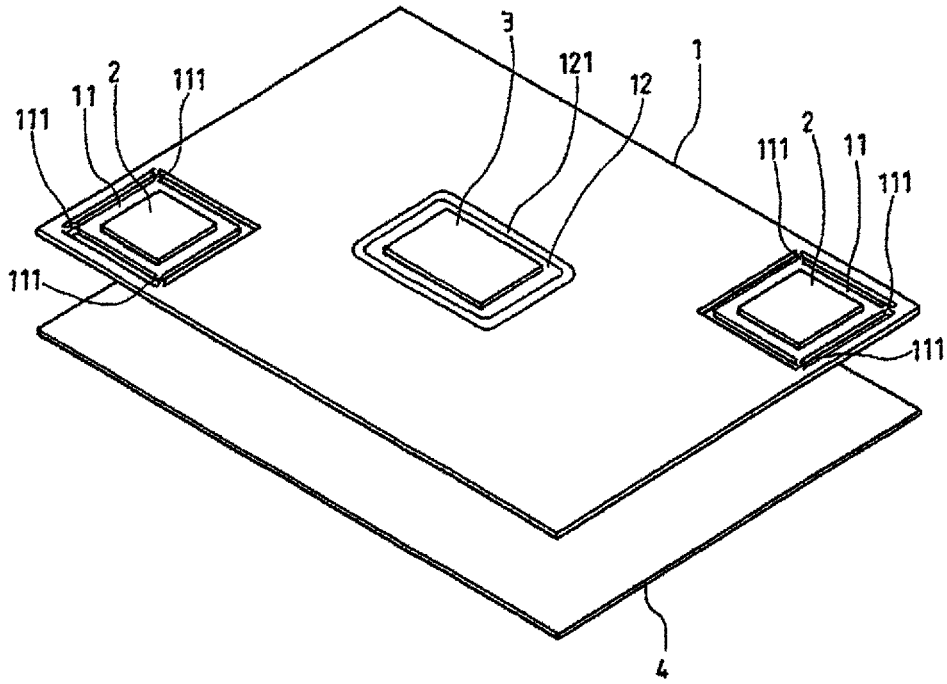
FIG. 1 is a perspective view of the present invention.
Figure 2:
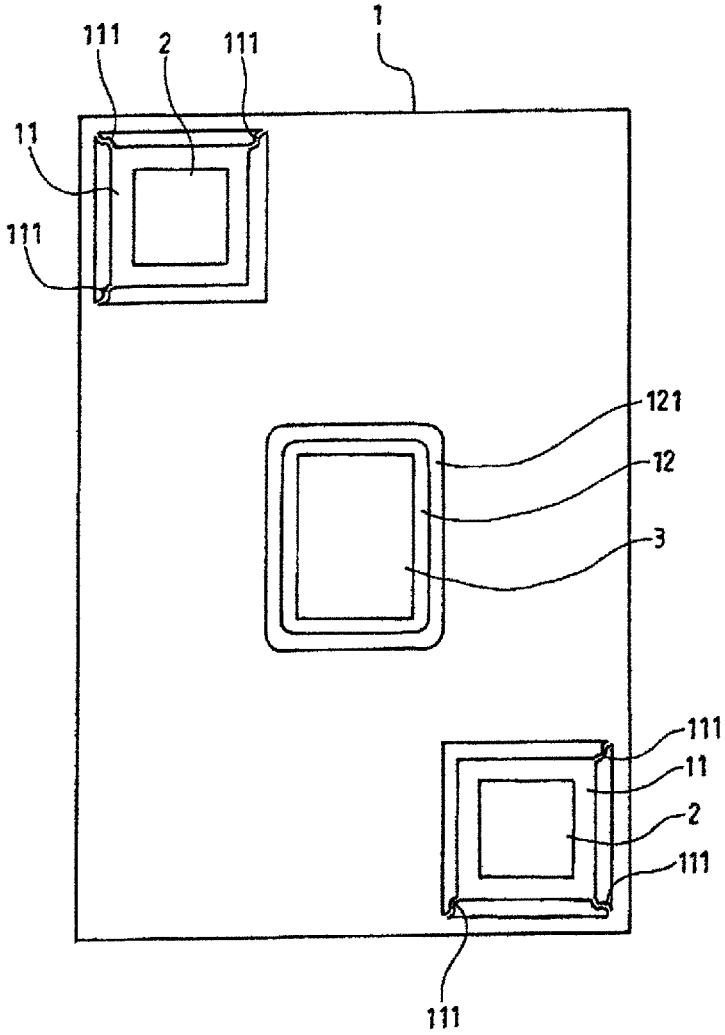
FIG. 2 is a plan view of the present invention.

Referring to FIGS. 1 and 2, which respectively are a perspective view and plan view of the present invention, a slim speaker structure having a vibration effect of the present invention includes a frame 1, different response frequencies of vibration and sound ceramic elements 2, 3 configured on a surface of the frame 1, and a sound membrane 4 disposed on the bottom of the frame 1, wherein two or more than two first accepting portions 11 (they are disposed on the symmetric corners, but may also disposed on the four corners) are respectively on locations of the frame 1 adjacent to sides thereof, allowing corners of the first accepting portions 11 are respectively coupled to the main body of the frame 1 with an overhanging section 111 so as to cause the first accepting portion 11 to form a suspension body, where each overhanging section 111 is a strip-typed and approximately continuously bended body, thereby allowing the vibration ceramic element to be mounted on the respect first accepting portion 111.

A second accepting portion 12 is disposed on the center of the frame 1, allowing the second accepting portion 12 to be coupled to the main body of the frame 1 with a corrugated arch section 121, thereby allowing the sound ceramic element 3 to be mounted on the second accepting portion 12.

A slim speaker having a vibration effect is constituted by the combination of the above components, thereby being applied on a product with a touch screen such as cellular phone or tablet. Signals are received through the vibration ceramic element 2 to yield vibration and sounds such as music and speech are broadcasted through the sound ceramic element 3 so as to constitute vibration prompt and sound broadcasting at the same plane, thereby reducing the space occupied by the components, and further allowing products such as cellular phones or tablets to be more thinned.

Figure 3:
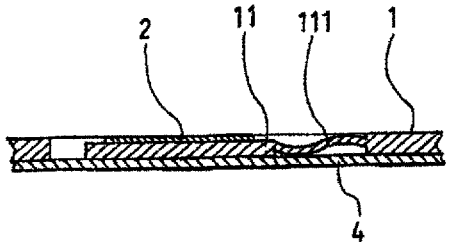
FIG. 3 is a cross sectional view of a first accepting portion of the present invention.

Referring to FIG. 3, which is a cross sectional view of a first accepting portion of the present invention, the first accepting portion 11 is coupled to the main body of the frame 1 with the strip-typed and approximately continuously bended overhanging section 111, allowing the first accepting portion 11 to form a suspension body. Therefore, the transmission of oscillatory waves can be eliminated when the vibration ceramic element 2 receives signals to yield vibration, because the first accepting portion 11 is coupled to the main body of the frame 1 only with the overhanging section 111 instead of with a plane having a larger area, and the overhanging section 111 is designed bended continuously, thereby preventing the oscillatory wave interference to the sound ceramic element 3 of the second accepting portion 12.

Figure 4:
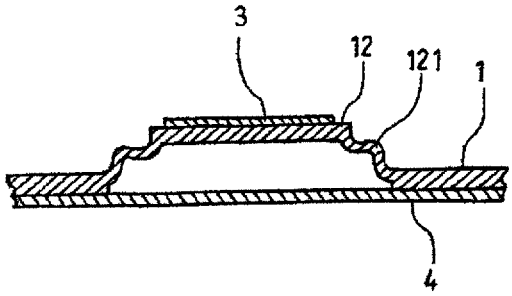
FIG. 4 is a cross sectional view of a second accepting portion of the present invention.

Referring to FIG. 4, which is a cross sectional view of a second accepting portion of the present invention, the second accepting portion 12 is coupled to the main body of the frame 1 with a corrugated arch portion 121, allowing the arch section 121 to form an elastic wave action like a general speaker does, thereby allowing the arch section 121 to constitute a portion of a braking structure, and further increasing the sound quality of the sound ceramic element 3 when the sound ceramic element 3 receives signals to generate sound, because the second accepting portion 12 is coupled to the main body of the frame 1 through the arch section 121 instead of a flat plane.

Figure 5:
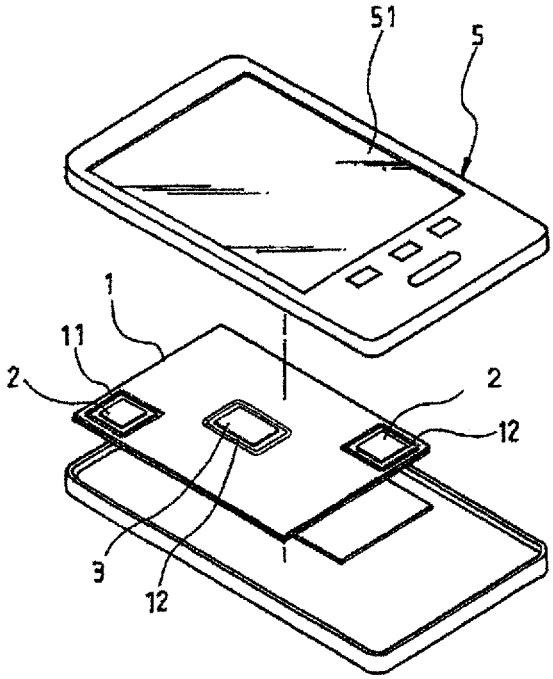
FIG. 5 is a perspective of the present invention in use according to the present invention.

Referring to FIG. 5, which is a perspective view of the embodiment of the present invention taken into practice, a slim speaker structure having a vibration effect of the present invention may be applied on products such as a cellular phone 5 with a touch screen (or tablet) while the present invention is in use; the present invention is installed under a touch panel 51 of the cellular phone 5. Because the speaker is thinned and the vibration element is used without a micromotor, the structure for vibration prompt and speaker for emitting sound may be configured on the same plane, thereby to reduce the accepting space for the whole element, allowing the cellular phone 5 (or tablet) to be more thinned so as to increase product competiveness.

Conclusively, the present invention adopts the configuration of a frame with different accepting portions matching with vibration and sound ceramic elements received in the accepting portions to form a slim speaker structure having a vibration effect. Sound broadcasting and vibration prompt are constituted at the same plane through the different ceramic elements, thereby to apply on products such as cellular phones or tablets with a touch screen, allowing the products to be more thinned.

I claim:

1. A slim speaker structure having a vibration effect, comprising: a frame; vibration and sound ceramic elements, having different response frequencies; and a sound membrane, disposed on a bottom of said frame, wherein said frame is configured with at least two first accepting portions respectively positioned on locations adjacent to sides thereof, allowing corners of said first accepting portions to be respectively coupled to a main body to said frame with an overhanging section, and then allowing said first accepting portion to form a suspension body, and said vibration ceramic element to be mounted on each said first accepting portion; a center of said frame being disposed with a second accepting portion, allowing said sound ceramic element to be mounted on said second accepting portion, thereby allowing said structure to be applied on a product having a touch screen, and signals being received to generate vibration through said vibration ceramic elements and sounds being broadcasted through said sound ceramic element to constitute vibration prompt and sound broadcasting at the same plane, thereby reducing space occupied by said components, and further allowing said product to be more thinned;

wherein each of said first accepting portions having peripheral edges connected with said corners, section of said first accepting portion being a strip-typed and continuously bended body connecting between each of selected ones of the corners of said first accepting portion and the frame so that the remaining ones of the corners and said peripheral edges of said first accepting portion being in a suspended condition; and wherein said second accepting portion is coupled to said main body of said frame with a corrugated arch section for generating an elastic wave action.

2. The structure according to claim 1, wherein said first accepting portions are configured symmetrically on corners of said frame.

* * * * *